United States Patent [19]

Holstein

[11] 4,380,977

[45] Apr. 26, 1983

[54] DEVICE FOR SELECTIVELY CONTROLLING THE NUMBER OF OPERATIVE CYLINDERS IN MULTI-CYLINDER ENGINES

[76] Inventor: Edward Holstein, 284 Rouge Rd., Winnipeg, Manitoba, Canada, R2W 1V7

[21] Appl. No.: 209,965

[22] Filed: Nov. 24, 1980

[51] Int. Cl.[3] ..... F02D 17/02

[52] U.S. Cl. ..... 123/198 F; 261/23 A

[58] Field of Search ..... 123/198 F; 261/23 A

[56] References Cited

U.S. PATENT DOCUMENTS

| | | | |
|---|---|---|---|
| 2,085,818 | 7/1937 | Messinger, Jr. | 123/198 F |
| 2,114,655 | 4/1938 | Leibing | 123/198 F |
| 4,080,948 | 3/1978 | Dolza, Sr. | 123/198 F |
| 4,106,471 | 8/1978 | Nakajima | 123/198 F |
| 4,109,634 | 8/1978 | Garabedian | 123/198 F |
| 4,215,845 | 8/1980 | Sturgeon | 123/198 F |

*Primary Examiner*—Ira S. Lazarus
*Attorney, Agent, or Firm*—Stanley G. Ade

[57] ABSTRACT

A manual or automatically operated valve assembly is situated between one of the carburettor barrels and the intake manifold leading to four of the cylinders in an 8-cylinder engine or three of the cylinders in a V-6 engine. When open, the engine functions normally, but when closed, four of the cylinders are cut off from the carburettor so that the engine operates on only four cylinders. At the same time air intake ports open up so that a controlled amount of air is drawn into the inoperative four cylinders and exhausted through the exhaust valves so that these four cylinders will operate against a relatively low compression as well as acting as a vacuum breaker in order to stop oil pumping passed the piston rings. Control of the amount of air is by varying the size of these air intake ports.

26 Claims, 8 Drawing Figures

DEVICE FOR SELECTIVELY CONTROLLING THE NUMBER OF OPERATIVE CYLINDERS IN MULTI-CYLINDER ENGINES

BACKGROUND OF THE INVENTION

This invention relates to new and useful improvements in devices for selectively controlling the number of operating cylinders in a multi-cylinder internal combustion engine.

Many attempts have been made to restrict the operation of some of the cylinders of a multi-cylinder engine once the vehicle has reached operating speed in an attempt to reduce the fuel consumption thereof.

These are particularly applicable for use with V-6 or V-8 engines which utilize either two or four barrels with half the barrels being operatively connected to half of the cylinders and the other half of the barrels being operatively connected to the other half of the cylinders in a relatively balanced relationship.

Examples known to applicant include U.S. Pat. No. 4,098,252 which utilizes the disconnection of the fuel pump from the cylinders not being used. U.S. Pat. No. 4,161,166 is controlled by placing the inlet and exhaust valve of the unwanted or unused cylinders in an inoperative position.

U.S. Pat. No. 4,124,012 shuts off the fuel on the cylinders not being used and venting is by end shifting of the interior of the spark plug. U.S. Pat. Nos. 4,019,479 shows a split type engine which is controlled by throttle valves and 4,135,484 shows a split type engine in which the two groups of cylinders are controlled by the operation and manipulation of the fuel lines by means of solenoids and the like.

U.S. Pat. No. 4,080,948 utilizes a sliding shuttle valve which is adapted to allow both barrels of the carburettor to communicate with the two groups of cylinders when in one position but allows only one barrel to operate when in the other position and at the same time provides venting to the unused cylinders. A third position is also provided which is intermediate position in order to smooth out the transition from one position to another.

All of these suffer from many disadvantages which include difficulty in venting of the unused cylinders so that the engine is not working against full compression of these unused cylinders and the difficulty in relieving the vacuum on the intake strokes of the unused cylinders which tends to permit oil to be pumped past the piston rings.

Other disadvantages include extremely involved mechanical and/or electrical apparatus and difficulty in providing devices which can be retrofitted to existing engines.

The present invention overcomes all of these disadvantages by providing an assembly which is easily retrofitted or which alternatively can be installed during manufacture.

In accordance with the invention there is provided a device for selectively controlling the number of operative cylinders in a multi-cylinder internal combustion engine which includes a multi--barrel carburettor and an attaching flange therefor, with half of the barrels being operatively connected to half of the cylinders and the other half of the barrels being operatively connected to the other half of the cylinders, intake manifolds operatively connected between the barrels and the cylinders operatively connected thereto; comprising in combination a valve assembly operatively connected between the half of the barrels of the carburettor and the manifold operatively connected thereto, said valve assembly being movable from a barrel shut off position to a barrel open position and vice versa, means to move the valve assembly from one position to the other position and relief air intake means between atmosphere and said manifold, said air intake means being operatively connected to said manifold when said valve assembly is in the barrel shut off position and disconnected from said manifold when said valve assembly is in the barrel open position.

Another advantage of the present invention is to provide a device of the character herewithin described which may, if desired, include metering plates within the communication apertures between the carburettor and the intake manifold which not only balance the two manifolds when the device is in operation but also can be used to restrict the maximum amount of fuel/air mixture delivered by the carburettor when same is wide open so that the top speed of the engine may be limited, for example, to close to the existing speed limit of 55 miles per hour in the United States.

Another advantage of the present invention is to provide a device of the character herewithin described which is preferably manually operated but can, of course, readily be adopted for use to automatic operation if desired.

A still further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
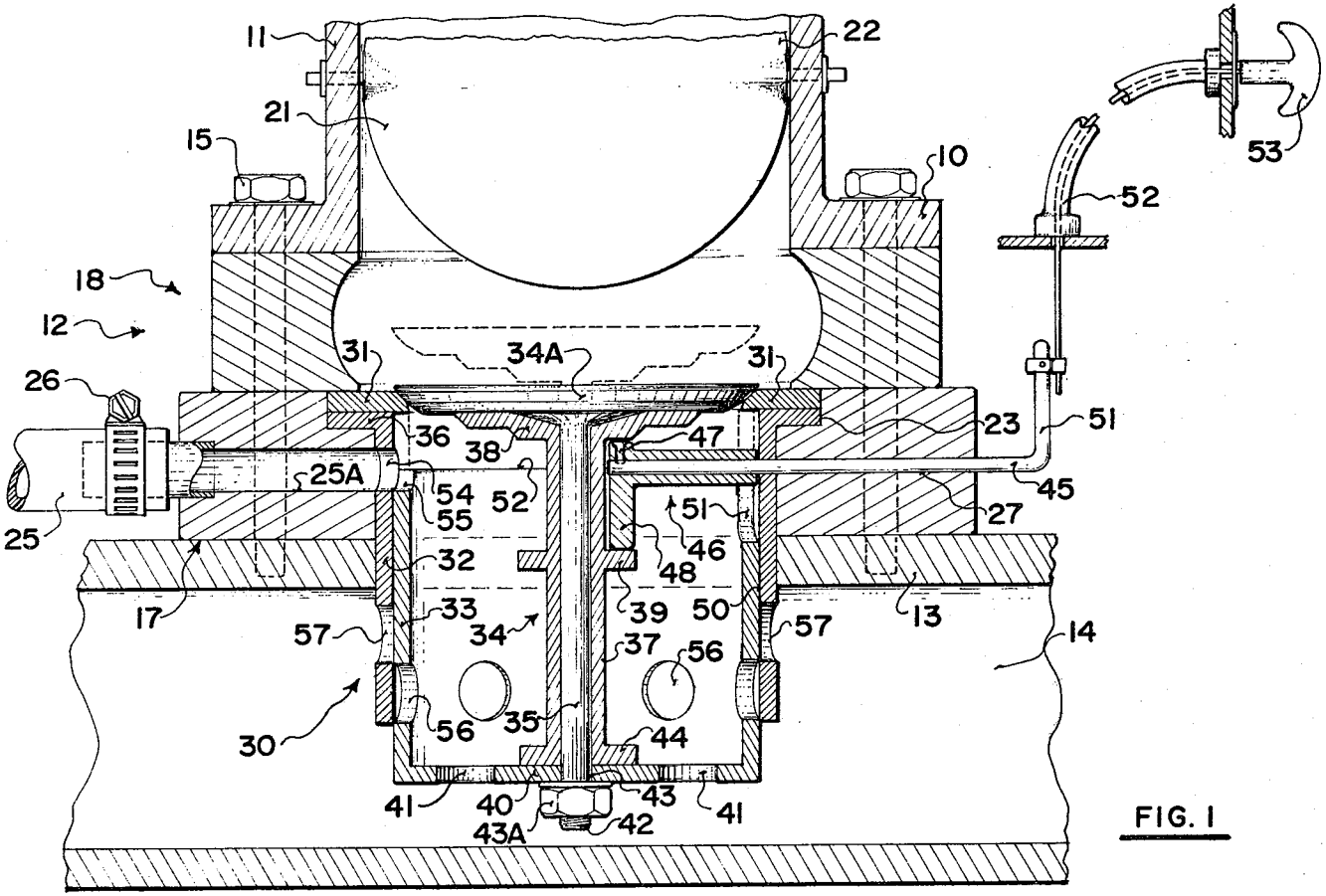
FIG. 1 is a vertical section of the device shown schematically for clarity and also being shown installed between the mounting flange of the carburettor and the intake to the intake manifold.
Figure 2:
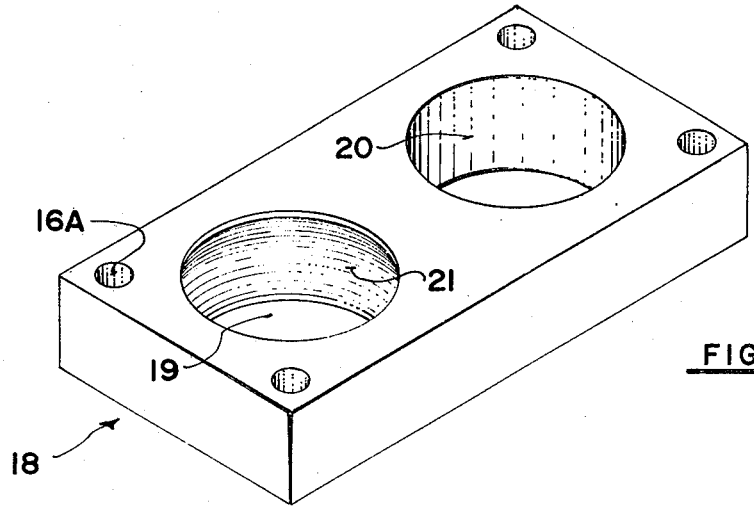
FIG. 2 is an isometric view of the spacer plate per se.

Proceeding therefore to describe the invention in detail, reference should first be made to FIG. 1 in which 10 illustrates the base mounting flange of a conventional carburettor 11. This carburettor may be of a two or four barrel type with half of the barrels being operatively connected to half of the cylinders of the engine and the other half of the barrels being operatively connected to the other half of the cylinders as is conventional.

The device collectively designated 12 is situated between the carburettor base flange 10 and the carburettor mounting flange 13 of the intake manifolds 14, one of which only is shown in FIG. 1.

The device is assembled in position by means of relatively long carburettor nut and bolt assemblies 15 extending through existing apertures within the flanges 10 and 13 and through apertures 16A and 16B in the various components making up the assembly as will hereinafter be described. It should also be appreciated that conventional sealing gaskets (not illustrated) are provided where necessary in order to prevent air leakage occurring between the various components as is conventional in carburettor assembly.

The device collectively designated 12 includes a mounting plate collectively designated 17 and a spacer plate collectively designated 18 situated above the mounting plate and being situated between flanges 10 and 13 and secured by means of the aforementioned nut and bolt assemblies 15 as hereinbefore described.

Reference to FIG. 1 will show details of the spacer plate 18 which is substantially rectangular when viewed in plan and shaped to suit the base flange 10 of the carburettor. As mentioned previously, the carburettor may be provided with two or four barrels and although the present description and drawings show two such barrels, nevertheless the operation with four barrels is similar inasmuch as the connection to the sets of cylinders is the same.

The spacer plate 18 is provided with apertures 19 and 20 matching the two barrels of the carburettor one of which 21 is illustrated and the spacer plate is provided primarily so that the assembly collectively designated 12 does not interfere with the conventional butterfly valve 22 shown schematically in FIG. 1, when same is in the fully opened position.

The aperture 19 operatively connecting with the assembly 12, is provided with an annulus 21 between the upper and lower surfaces of the spacer plate to provide increased fuel/air flow when the device is in the inoperative position as will hereinafter be described.

Figure 3:
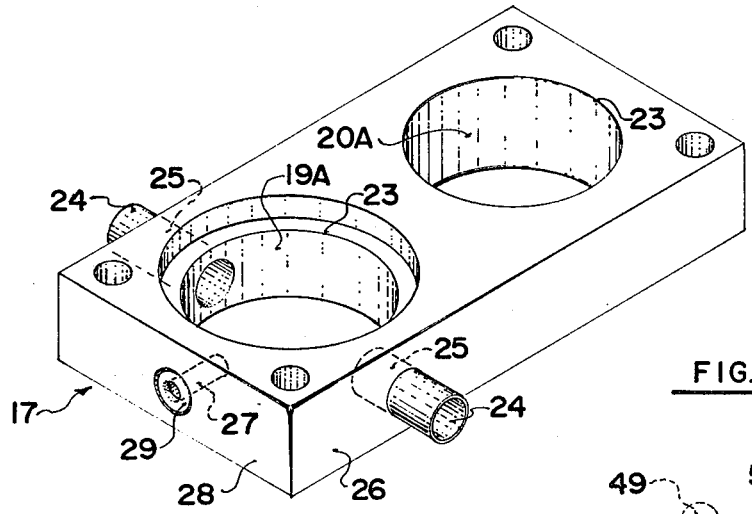
FIG. 3 is an isometric view of the mounting plate per se.

The mounting plate 17 is shown in detail in FIG. 3 and is of a similar rectangular configuration when viewed in plan, to the spacer plate 18 situated thereabove. It also includes a pair of communication bores 19A and 20A in alignment with the bores 19 and 20 of the spacer plate, when the device is assembled as illustrated in FIG. 1.

Both bores 19A and 20A are counter-bored from the upper surface 22 thereof as clearly shown in FIGS. 1 and 3 and indicated by reference character 23, the purpose of which will hereinafter be described.

The communication aperture 19A is connected to external bushings 24 by means of transverse drillings 25 extending from each side 26 of the mounting plate 17 to the wall of the bore 19A and flexible hoses 25, secured by clamps 26, extend from these bushings to the air cleaner (not illustrated) of the carburettor.

A further drilling 27 extends through the mounting plate 17 from one end wall 28 thereof also to the wall of the communication aperture 19A and this drilling or bore 27 is provided with an annular groove carrying a flexible O ring 29 for sealing purposes as will hereinafter be described.

Reference to FIG. 3 will show that the bores or drillings 25 extend inwardly from the sides 26 and that the bore 27 is substantially at right angles to the bores 25. However, in FIG. 1, which is shown schematically for clarity, bore or drilling 27 is shown in alignment with the air intake bore 25.

A valve assembly is provided collectively designated 30. It consists of a valve seat 31, a cylinder 32, a hollow piston 33, a valve collectively designated 34 and means to operate the valve collectively designated 35.

The cylinder 32 is provided with an upper outturned flange 36 and this flange rests within the counterbore 23 in the mounting plate 17 with the valve seat 31 being situated thereabove, with both the seat and the cylinder being clamped in position within the counterbore by the engagement of the spacer plate 18 as clearly shown in FIG. 1.

Figure 4:
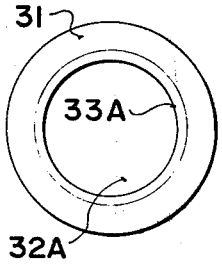
FIG. 4 is a top plan view of the metering plate and/or the valve seat.

FIG. 4 shows details of the valve seat which may also act as a metering plate as will hereinafter be described. It consists of an annular disc being centrally apertured as at 32 with a chamfered valve seat 33 formed thereon.

The cylinder 32 depends into the manifold 14 as clearly shown and the valve is a poppet type valve comprising a valve head 34 with a valve stem 35 extending from the centre of the underside of the valve head in the usual manner. The perimeter of the valve head 34 is also chamfered as at 36 and sealably engages the chamfered seat 33A of the seat 31 in the usual manner when closed.

A cam follower cylinder 37 surrounds the valve stem and a cam plate or disc 38 is situated at the upper end of the cylinder against the underside of the valve head 34. A cam return plate 39 extends from the cylinder 37 spaced below the plate 38, the purpose of which will hereinafter be described.

The piston 33 is a hollow piston with an open upper end and an apertured lower end or plate 40 with apertures 41 being formed therethrough. The lower end 42 of the valve stem is screw threaded and extends through a centrally located drilling 43 within the piston base and nut 43A engages the screw threaded end and clamps together, the piston 33, the valve 34 and the cam follower cylinder 37, the lower end of which is provided with collar 44 so that these parts form a single unit.

The valve can move from the barrel closed or barrel shut off position shown in full line in FIG. 1 to the barrel open position shown in phantom in FIG. 1 and when in the open position, the annular groove 21 in the aperture in the spacer plate 18 prevents undue restriction of the fuel/air mixture passed the valve head, and hence into the intake manifold 14.

Figure 5:
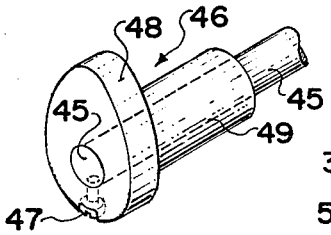
FIG. 5 is an isometric view of the cam and cam shaft per se.

The cam assembly 35 used to control the movement of the valve 34 comprises a cam shaft 45 journalled for partial rotation within the bore or drilling 27 in the mounting block 17, said cam shaft having a cam and spacer 46 secured on the inner end thereof by means of set screw 47. Details of this assembly are shown in FIG. 5.

The cam and cam spacer 46 consist of a single load cam 48 mounted upon the end of a short cylinder spacer tube 49 which engages over the inner end of cam shaft 45 and is secured thereto by means of set screw 47. The spacer extends from the cam 48 to a point against the inner wall 50 of the cylinder 33 and registers within a vertical slot 51 extending downwardly from the upper end 52 of the piston 33. The cam bears against the underside of the plate 38 when the shaft and cam are partially rotated in one direction thus moving the valve upwardly to the position shown in phantom in FIG. 1. Conversely, when the cam shaft and cam are partially rotated in the opposite direction, the cam engages the plate 39 and moves the valve downwardly to the closed position shown in full line in FIG. 1 and maintains the valve firmly upon the seat when in this position.

A cam lever 51 is secured to the distal end of the cam shaft beyond the mounting plate 17 and a flexible push-pull cable assembly 52 extends from this lever to a convenient location adjacent the operator so that the cable can be moved inwardly and outwardly by means of the knob 53 thus providing the necessary partial rotation to the cam shaft.

Alternatively, it will be appreciated that such movement can be made automatic by various means.

When the valve assembly is in the position shown in full line in FIG. 1, the valve is in the barrel shut-off position so that no fuel/air mixture can pass from this particular barrel to the intake manifold 14. However, relief air is provided through the flexible hoses 25 and through the bores or drillings 25A and through an aperture 54 within the cylinder 32 and through an aperture 55 within the piston 33 which, in the position shown, aligns with aperture 54. It passes downwardly through the interior of the piston and into the manifold through the apertures 41 within the base thereof.

However, when moved to the open position shown in phantom in FIG. 1 or in the barrel open position, the wall of the piston 33 shuts off the apertures 54 in the cylinder thus shutting off the relief air intakes.

At the same time, a plurality of apertures 56 around the skirt of the piston 33 move upwardly into alignment with corresponding apertures 57 formed through the wall of the cylinder 32 thus providing plenty of intake area for the fuel/air mixture passing the valve head 34A into the manifold 14.

In order to balance the quantity of fuel/air mixture passing through the plurality of barrels when the valve assembly is in the "barrel open" position, a metering plate similar to the valve seat 31 may be engaged within the counterbore of the other barrels. Both these metering plates and the valve seat may be sized to restrict the total quantity of fuel/air mixture entering the cylinders even when the butterfly valves 22 are in the full position thus controlling the maximum speed of the engine and hence the maximum speed of the car.

Figure 7:
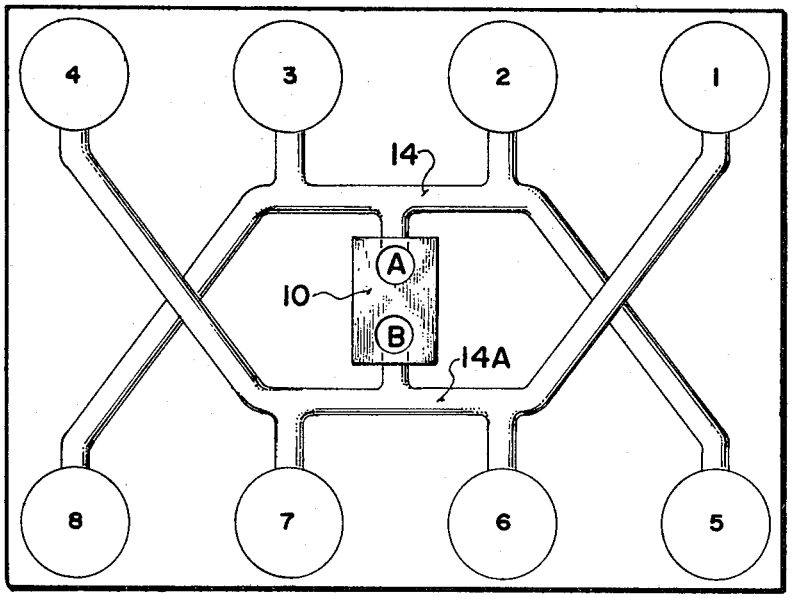
FIG. 7 is a schematic plan view showing the connection of the device to a V-8 engine.
Figure 8:
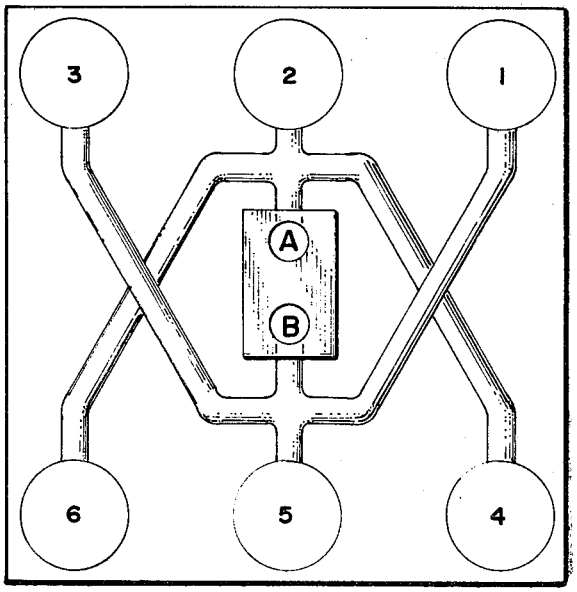
FIG. 8 is a view similar to FIG. 7 but showing the connection to a V-6 engine.

Finally, reference should be made to FIGS. 7 and 8 with FIG. 7 illustrating schematically, a V-8 engine and a two-barrel carburettor intake base 10.

Normally, one barrel "A" is connected to cylinders 2, 3, 5 and 8 and the other barrel "B" is connected to the cylinders 1, 4, 6 and 7 via the inlet manifold 14 and 14A respectively. With the device installed in the base of the barrel "A", when the valve is closed, cylinders 2, 3, 5 and 8 are inoperative and the engine operates on cylinders 1, 4, 6 and 7.

Figure 6:
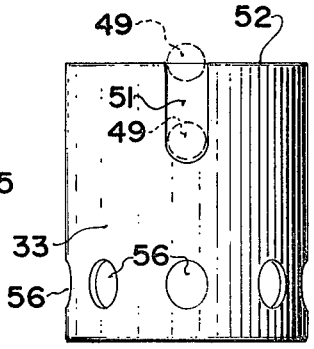
FIG. 6 is a side elevation of the cylinder per se.

FIG. 6 shows the equivalent connections for a V-6 engine under which circumstances, with the valve closed, the engine will operate on cylinders 1, 3 and 5.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A device for selectively controlling the number of operative cylinders in a multi-cylinder internal combustion engine which includes a multi-barrel carburettor and an attaching flange therefor, with one half of the barrels being operatively connected to one half of the cylinders and the other half of the barrels being operatively connected to the other half of the cylinders, intake manifolds operatively connected between the barrels and the cylinders operatively connected thereto; comprising in combination a valve assembly operatively connected between the one half of the barrels of the carburettor and the manifold operatively connected thereto, said valve assembly being movable from a barrel shut off position to a barrel open position and vice versa, means to move the valve assembly from one position to the other position and relief air intake means between atmosphere and said manifold, said air intake means being operatively connected to said manifold when said valve assembly is in the barrel shut off position and disconnected from said manifold when said valve assembly is in the barrel open position, said device including an apertured mounting plate operatively secured between the carburettor flange and the intake manifolds, said mounting plate including a communication aperture between said one half of said barrels and the corresponding intake manifold and a further communication aperture between said other half of said barrels and said other intake manifold, said valve assembly being situated within one of said apertures, said valve assembly including a valve seat surrounding the upper end of the communication aperture in which the valve assembly is situated, a valve having a valve head and a stem depending therefrom, said head being operatively engageable with said seat, a piston and cylinder, said cylinder extending from adjacent said seat into the manifold connected to said one of said communication apertures, said piston being operatively connected to said valve stem for movement therewith and means operatively connecting said relief air intake means to the interior of said piston when said valve is in the barrel shut off position.

2. The invention according to claim 1 which includes first means communicating between the interior of said piston and said manifold regardless of the position of said valve and second means operatively connected between the interior of the piston and said manifold when the valve is in the barrel open position but being disconnected when said valve is in the barrel shut off position.

3. The invention according to claim 2 in which said first means includes apertures in the base of said piston.

4. The invention according to claim 2 in which said second means includes apertures through the skirt of said piston and apertures through the wall of said cylinder, said apertures in said skirt and said wall being in alignment when said valve is in the barrel open position but being misaligned when said valve is in the barrel shut off position.

5. The invention according to claim 1 in which said means to move said valve assembly includes a cam shaft extending through said mounting plate, means to partially rotate said cam shaft, a cam on the inner end of said cam shaft within said piston and below said valve head, said cam operatively engaging said valve head whereby partial rotation of said cam by said cam shaft moves said valve head to the barrel open position, and means to return said valve head to the barrel closed position, said last mentioned means including a cam follower surrounding said valve stem engageable by said cam when said cam is partially rotated by said cam shaft in the opposite direction thereby positively closing said valve head upon said valve seat, and a vertical slot within the wall of said piston, said valve stem engaging within said slot for movement of said piston relative to said cam shaft.

6. The invention according to claim 2 in which said means to move said valve assembly includes a cam shaft extending through said mounting plate, means to partially rotate said cam shaft, a cam on the inner end of said cam shaft within said piston and below said valve head, said cam operatively engaging said valve head whereby partial rotation of said cam by said cam shaft moves said valve head to the barrel open position, and means to return said valve head to the barrel closed position, said last mentioned means including a cam follower surrounding said valve stem engageable by said cam when said cam is partially rotated by said cam shaft in the opposite direction thereby positively closing said valve head upon said valve seat, and a vertical slot within the wall of said piston, said valve stem engaging within said slot for movement of said piston relative to said cam shaft.

7. The invention according to claim 3 in which said means to move said valve assembly includes a cam shaft extending through said mounting plate, means to partially rotate said cam shaft, a cam on the inner end of said cam shaft within said piston and below said valve head, said cam operatively engaging said valve head whereby partial rotation of said cam by said cam shaft moves said valve head to the barrel open position, and means to return said valve head to the barrel closed position, said last mentioned means including a cam follower surrounding said valve stem engageable by said cam when said cam is partially rotated by said cam shaft in the opposite direction thereby positively closing said valve head upon said valve seat, and a vertical slot within the wall of said piston, said valve stem engaging within said slot for movement of said piston relative to said cam shaft.

8. The invention according to claim 4 in which said means to move said valve assembly includes a cam shaft extending through said mounting plate, means to partially rotate said cam shaft, a cam on the inner end of said cam shaft within said piston and below said valve head, said cam operatively engaging said valve head whereby partial rotation of said cam by said cam shaft moves said valve head to the barrel open position, and means to return said valve head to the barrel closed position, said last mentioned means including a cam follower surrounding said valve stem engageable by said cam when said cam is partially rotated by said cam shaft in the opposite direction thereby positively closing said valve head upon said valve seat, and a vertical slot within the wall of said piston, said valve stem engaging within said slot for movement of said piston relative to said cam shaft.

9. The invention according to claim 5 in which said means to move said valve assembly includes a cam shaft extending through said mounting plate, means to partially rotate said cam shaft, a cam on the inner end of said cam shaft within said piston and below said valve head, said cam operatively engaging said valve head whereby partial rotation of said cam by said cam shaft moves said valve head to the barrel open position, and means to return said valve head to the barrel closed position, said last mentioned means including a cam follower surrounding said valve stem engageable by said cam when said cam is partially rotated by said cam shaft in the opposite direction thereby positively closing said valve head upon said valve seat, and a vertical slot within the wall of said piston, said valve stem engaging within said slot for movement of said piston relative to said cam shaft.

10. The invention according to claim 1 in which said valve assembly includes said cylindrical piston having an open upper end and an apertured base, a cam follower cylinder surrounding said valve stem and including an upper cam engaging plate adjacent the underside of said valve head and a return plate extending from said cam follower cylinder spaced below said cam engaging plate, said valve stem extending through the base of said piston and means engaging the distal end of said valve stem clamping said valve, said valve follower cylinder and said piston together as one unit.

11. The invention according to claim 2 in which said valve assembly includes said cylindrical piston having an open upper end and an apertured base, a cam follower cylinder surrounding said valve stem and including an upper cam engaging plate adjacent the underside of said valve head and a return plate extending from said cam follower cylinder spaced below said cam engaging plate, said valve stem extending through the base of said piston and means engaging the distal end of said valve stem clamping said valve, said valve follower cylinder and said piston together as one unit.

12. The invention according to claim 3 in which said valve assembly includes said cylindrical piston having an open upper end and an apertured base, a cam follower cylinder surrounding said valve stem and including an upper cam engaging plate adjacent the underside of said valve head and a return plate extending from said cam follower cylinder spaced below said cam engaging plate, said valve stem extending through the base of said piston and means engaging the distal end of said valve stem clamping said valve, said valve follower cylinder and said piston together as one unit.

13. The invention according to claim 4 in which said valve assembly includes said cylindrical piston having an open upper end and an apertured base, a cam follower cylinder surrounding said valve stem and including an upper cam engaging plate adjacent the underside of said valve head and a return plate extending from said cam follower cylinder spaced below said cam engaging plate, said valve stem extending through the base of said piston and means engaging the distal end of said valve stem clamping said valve, said valve follower cylinder and said piston together as one unit.

14. The invention according to claim 5 in which said valve assembly includes said cylindrical piston having an open upper end and an apertured base, a cam follower cylinder surrounding said valve stem and including an upper cam engaging plate adjacent the underside of said valve head and a return plate extending from said cam follower cylinder spaced below said cam engaging plate, said valve stem extending through the base of said piston and means engaging the distal end of said valve stem clamping said valve, said valve follower cylinder and said piston together as one unit.

15. The invention according to claim 6 in which said valve assembly includes said cylindrical piston having an open upper end and an apertured base, a cam follower cylinder surrounding said valve stem and including an upper cam engaging plate adjacent the underside of said valve head and a return plate extending from said cam follower cylinder spaced below said cam engaging plate, said valve stem extending through the base of said piston and means engaging the distal end of said valve stem clamping said valve, said valve follower cylinder and said piston together as one unit.

16. The invention according to claim 7 in which said valve assembly includes said cylindrical piston having an open upper end and an apertured base, a cam follower cylinder surrounding said valve stem and including an upper cam engaging plate adjacent the underside of said valve head and a return plate extending from said cam follower cylinder spaced below said cam engaging plate, said valve stem extending through the base of said piston and means engaging the distal end of said valve stem clamping said valve, said valve follower cylinder and said piston together as one unit.

17. The invention according to claim 8 in which said valve assembly includes said cylindrical piston having an open upper end and an apertured base, a cam follower cylinder surrounding said valve stem and including an upper cam engaging plate adjacent the underside of said valve head and a return plate extending from said cam follower cylinder spaced below said cam engaging plate, said valve stem extending through the base of said piston and means engaging the distal end of said valve stem clamping said valve, said valve follower cylinder and said piston together as one unit.

18. The invention according to claim 9 in which said valve assembly includes said cylindrical piston having an open upper end and an apertured base, a cam follower cylinder surrounding said valve stem and including an upper cam engaging plate adjacent the underside of said valve head and a return plate extending from said cam follower cylinder spaced below said cam engaging plate, said valve stem extending through the base of said piston and means engaging the distal end of said valve stem clamping said valve, said valve follower cylinder and said piston together as one unit.

19. The invention according to claim 1, 2 or 3 which includes an apertured spacer plate operatively secured between said carburettor flange and said mounting plate, an apertured metering plate secured within said further communication aperture of said mounting plate, said metering plate restricting the communication aperture to balance the operation of both barrels.

20. The invention according to claim 4, 5 or 6 which includes an apertured spacer plate operatively secured between said carburettor flange and said mounting plate, an apertured metering plate secured within said further communication aperture of said mounting plate, said metering plate restricting the communication aperture to balance the operation of both barrels.

21. The invention according to claim 7, 8 or 9 which includes an apertured spacer plate operatively secured between said carburettor flange and said mounting plate, an apertured metering plate secured within said further communication aperture of said mounting plate, said metering plate restricting the communication aperture to balance the operation of both barrels.

22. The invention according to claim 10 or 11 which includes an apertured spacer plate operatively secured between said carburettor flange and said mounting plate, an apertured metering plate secured within said further communication aperture of said mounting plate, said metering plate restricting the communication aperture to balance the operation of both barrels.

23. The invention according to claim 12, 13 or 14 which includes an apertured spacer plate operatively secured between said carburettor flange and said mounting plate, an apertured metering plate secured within said further communication aperture of said mounting plate, said metering plate restricting the communication aperture to balance the operation of both barrels.

24. The invention according to claim 15, 16 or 17 which includes an apertured spacer plate operatively secured between said carburettor flange and said mounting plate, an apertured metering plate secured within said further communication aperture of said mounting plate, said metering plate restricting the communication aperture to balance the operation of both barrels.

25. The invention according to claim 18 which includes an apertured spacer plate operatively secured between said carburettor flange and said mounting plate, an apertured metering plate secured within said further communication aperture of said mounting plate, said metering plate restricting the communication aperture to balance the operation of both barrels.

26. The invention according to claim 1, 2 or 3 which includes an apertured spacer plate operatively secured between said carburettor flange and said mounting plate, an apertured metering plate secured within said further communication aperture of said mounting plate, said metering plate restricting the communication aperture to balance the operation of both barrels, said valve seat also acting as a metering plate, said metering plates also restricting the flow of the fuel/air mixture from said carburettor thereby limiting the maximum speed of said engine.

* * * * *